US008162600B2

(12) United States Patent
Brown et al.

(10) Patent No.: US 8,162,600 B2
(45) Date of Patent: Apr. 24, 2012

(54) SYSTEM, METHOD AND APPARATUS FOR TWO-PHASE HOMOGENIZING STAGE FOR CENTRIFUGAL PUMP ASSEMBLY

(75) Inventors: Donn J. Brown, Broken Arrow, OK (US); Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 701 days.

(21) Appl. No.: 12/331,745

(22) Filed: Dec. 10, 2008

(65) Prior Publication Data

US 2009/0155064 A1 Jun. 18, 2009

Related U.S. Application Data

(60) Provisional application No. 61/013,435, filed on Dec. 13, 2007.

(51) Int. Cl.
*F04D 29/44* (2006.01)
*F04D 29/54* (2006.01)

(52) U.S. Cl. ..... 415/199.2; 415/211.2

(58) Field of Classification Search ..... 415/199.2, 415/199.6, 211.2, 104, 206
See application file for complete search history.

(56) References Cited

U.S. PATENT DOCUMENTS

| | | | | |
|---|---|---|---|---|
| 4,142,839 | A | 3/1979 | Davis et al. | |
| 4,643,639 | A | 2/1987 | Caine | |
| 4,865,519 | A | 9/1989 | Diankui et al. | |
| 5,628,616 | A | 5/1997 | Lee | |
| 5,830,584 | A * | 11/1998 | Chen et al. | 428/611 |
| 5,961,282 | A | 10/1999 | Wittrisch et al. | |
| 6,007,306 | A | 12/1999 | Vilagines | |
| 6,312,216 | B1 | 11/2001 | Falcimaigne | |
| 7,025,557 | B2 | 4/2006 | Japikse et al. | |
| 2005/0100439 | A1 * | 5/2005 | Greim et al. | 415/173.5 |

FOREIGN PATENT DOCUMENTS

| | | |
|---|---|---|
| KR | 20-0119717 Y1 | 7/1998 |
| KR | 20-0179820 Y1 | 4/2000 |

* cited by examiner

*Primary Examiner* — Chuong A Luu
*Assistant Examiner* — Nga Doan
(74) *Attorney, Agent, or Firm* — Bracewell & Giuliani LLP

(57) ABSTRACT

A two-phase, homogenizing or mixing stage for a centrifugal pump assembly homogenizes the fluids being circulated therethrough. The mixing stage produces high shut-in head pressure and a very high maximum flow rate. The mixing stage has a diffuser with fixed diffuser vanes that extend radially or tangentially at acute angles. The vanes may be curved in both the axial and radial directions to force fluids impinging thereon to have a radially inward component to create turbulence. The turbulence mixes and homogenizes the gas and liquid fluids to improve the overall performance of centrifugal pump assemblies that operate in two-phase fluids. The mixing stage also has an impeller adjacent the diffuser. The impeller vanes likewise extend radially and tangentially therefrom at acute angles and may be curved.

25 Claims, 8 Drawing Sheets

SYSTEM, METHOD AND APPARATUS FOR TWO-PHASE HOMOGENIZING STAGE FOR CENTRIFUGAL PUMP ASSEMBLY

This application claims priority to and the benefit of U.S. Provisional Patent Application No. 61/013,435 which was filed on Dec. 13, 2007, and is incorporated herein by reference in its entirety.

BACKGROUND OF THE INVENTION

1. Technical Field

The present invention relates in general to centrifugal pumps and, in particular, to an improved system, method, and apparatus for a two-phase homogenizing stage for a centrifugal pump assembly.

2. Description of the Related Art

Centrifugal pumps are primarily designed to handle liquids. However, in the presence of liquids having high percentages of free gas, centrifugal pumps will suffer from pressure degradation and gas locking. Moreover, extreme differences in the densities of the liquids and gases cause the gases to gather in the low pressure areas of the pump adjacent the impeller eye. This results in gas accumulation in the impeller and blocks the flow path for the liquids. Furthermore, free gas in the impeller stages displaces liquid and restricts the volumetric efficiency of the pump. As a result, the accumulation of free gas results in lower volumetric lift per pump stage, and a decline in expected production.

The theoretical best performance of a pump in a two-phase fluid is represented by what is known as the "homogeneous curve." The homogeneous performance of a pump is based on the hypothesis that if the size of gas bubbles is reduced to the point that the fluid drag forces completely dominate the buoyant forces, the two-phase fluid would behave as if it was a single-phase fluid whose only effect on performance would be the increased volume and the reduced bulk density. The two-phase performance of a pump can approach the homogeneous curve if the fluids can be homogenized and the homogeneity is maintained throughout the pump.

As shown in FIG. 10, pump performance curves are based on the assumption that the gas entrained in the liquid affects only two variables: (1) the volume of the total mixture, and (2) the density of the total mixture. Graphed against the liquid-only volume and the stage pressure, a curve paralleling the "all liquid" performance plot 101, but intersecting the horizontal flow axis at a value of "max liquid flow×1−Free Gas Fraction (or Gas Void Fraction)," and intersecting the vertical pressure axis at "max pressure×1−Free Gas Fraction" is shown. Other plots 103, 105 are shown for values of 10% and 25% free gas, respectively. The actual performance 107 is more severely affected by the gas as shown by the "Realistic curve at 25% free gas." If the gas cannot be mixed and carried through the pump, it tends to centrifugally separate, gather in the eye of the impeller and can block the liquid flow entirely. The term "shut in" or "shut off" refers to the flow control valve being shut. It represents the performance curve intersection at the vertical (zero flow) axis. Thus, a system, method and apparatus for improving the performance of centrifugal pump assemblies in two-phase fluid production would be desirable.

SUMMARY OF THE INVENTION

Embodiments of a system, method, and apparatus for a two-phase, homogenizing stage for a centrifugal pump assembly are disclosed. At least one mixing stage is used in the pump assembly to homogenize the fluids being circulated therethrough. The mixing stage produces high shut-in head pressure and a very high maximum flow rate.

One embodiment of the mixing stage has a diffuser with fixed diffuser vanes that extend radially or tangentially at acute angles. The vanes may be curved in both the axial and radial directions to force fluids impinging thereon to have a radially inward component to create turbulence. This turbulence mixes and homogenizes the gas and liquid fluids to improve the overall performance of centrifugal pump assemblies that operate in two-phase fluids. The mixing stage also has an impeller adjacent the diffuser. The impeller vanes likewise extend radially and tangentially therefrom at acute angles and may be curved.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Referring now to FIGS. 1-9 and 11-12, embodiments of a system, method and apparatus for a two-phase, homogenizing stage for a centrifugal pump assembly are disclosed. Some embodiments of the invention include a special mixing stage 11 (FIGS. 6-8) that may be placed at the bottom (see, e.g., FIG. 9) of the centrifugal pump assembly 13. In other embodiments, several of the mixing stages 11 may be axially spaced apart from each other between the other type(s) of conventional pump stages 12.

The mixing stages 11 are designed to homogenize the fluids being circulated through the centrifugal pump assembly. Gas and liquid are mixed together to enable them to pass through the pump in a substantially homogenous solution to minimize the accumulation of the gas in the impellers. The mixing stage 11 may comprise a specialized axial flow turbine. It produces high shut-in head pressure and a very high maximum flow rate. This mixing turbine could be used as a pump by itself, but for the fact that it suffers an efficiency penalty due to its designed-in turbulence.

Figure 8:
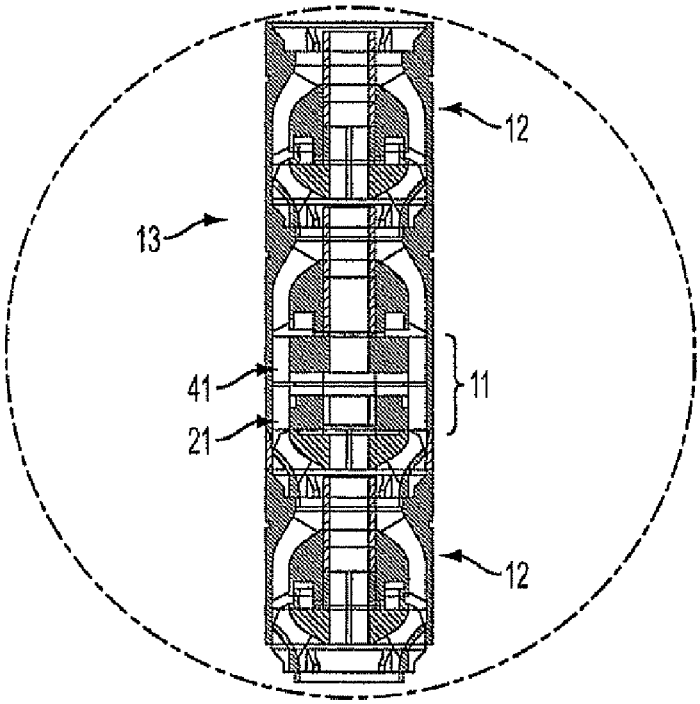
FIG. 8 is an enlarged sectional side view of one embodiment of a centrifugal pump assembly constructed in accordance with the invention.
Figure 9:
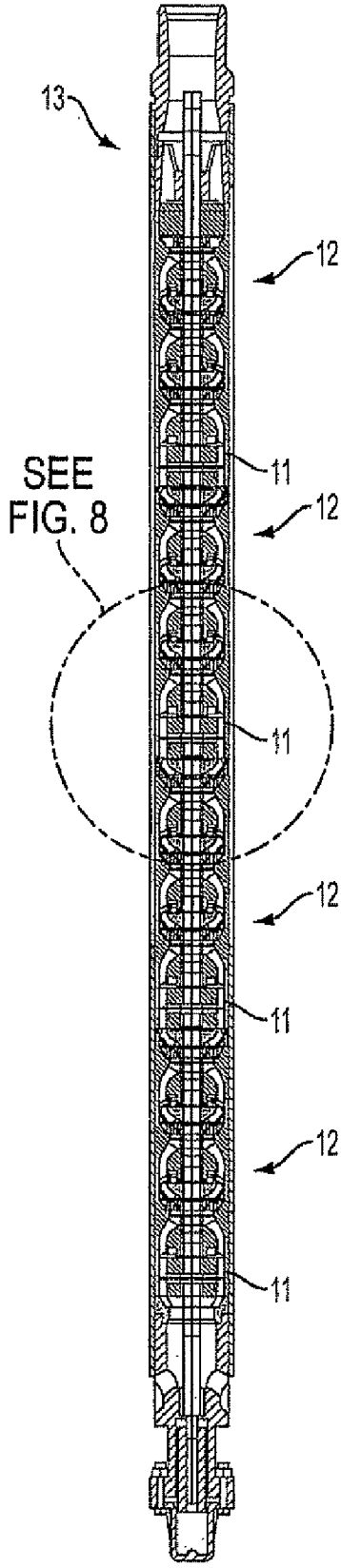
FIG. 9 is an overall sectional side view of one embodiment of a centrifugal pump assembly constructed in accordance with the invention.
Figure 10:
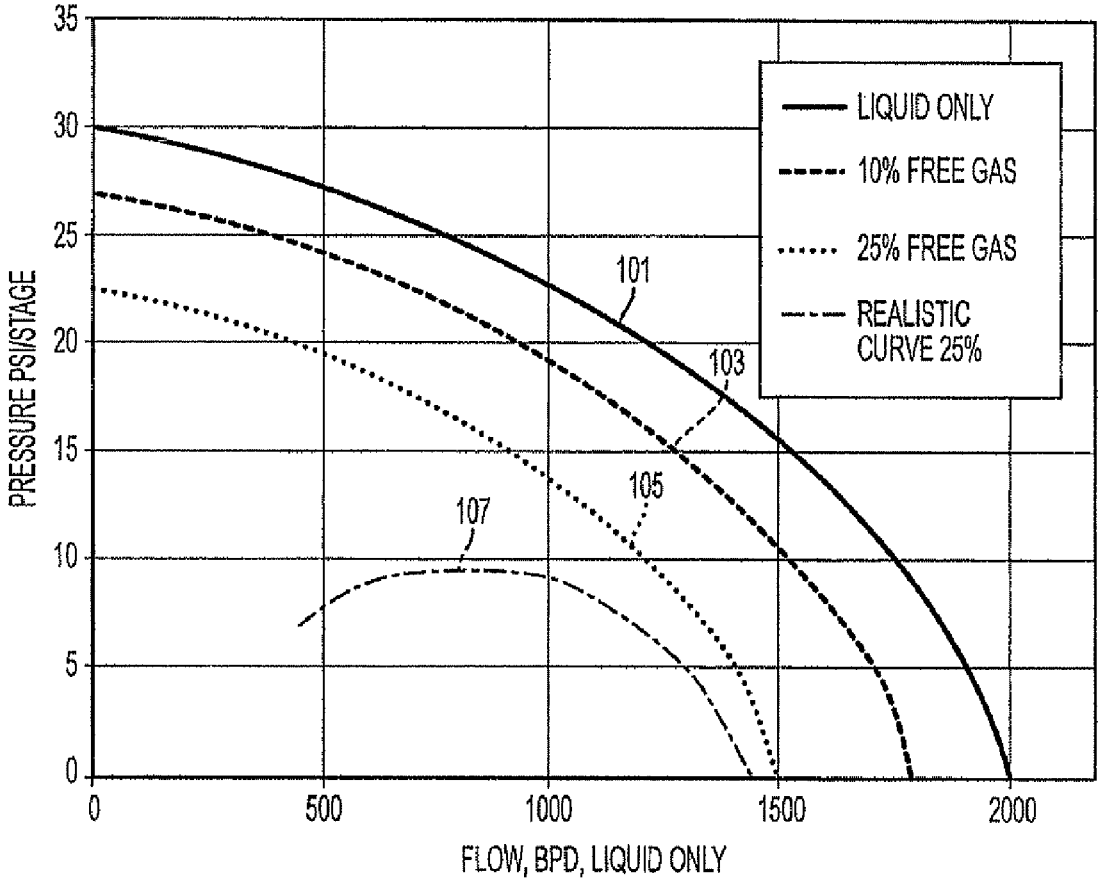
FIG. 10 is plot of centrifugal pump performance as a function of gas content.
Figure 11:
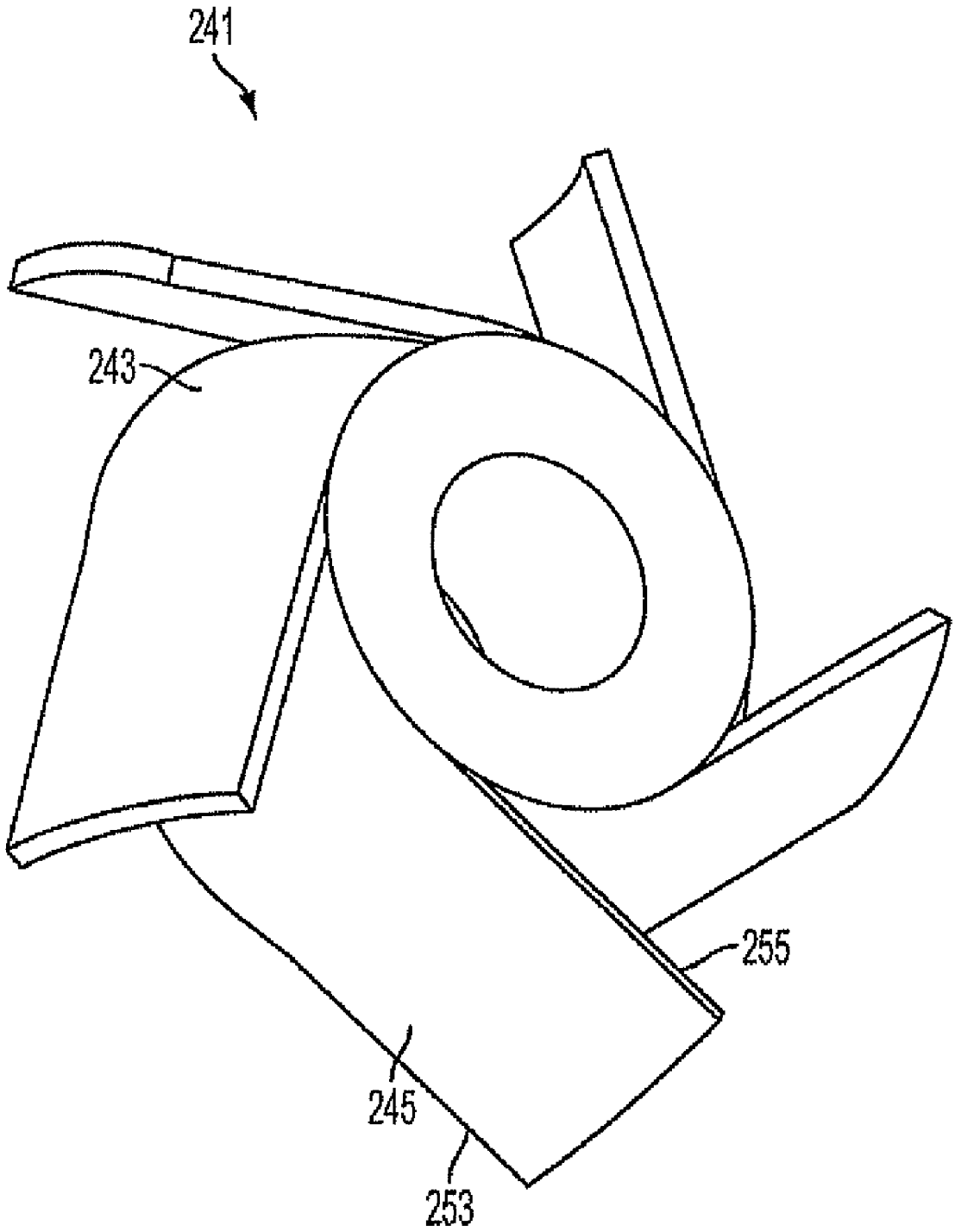
FIG. 11 is a bottom isometric view of another embodiment of a mixing stage constructed in accordance with the invention.
Figure 12:
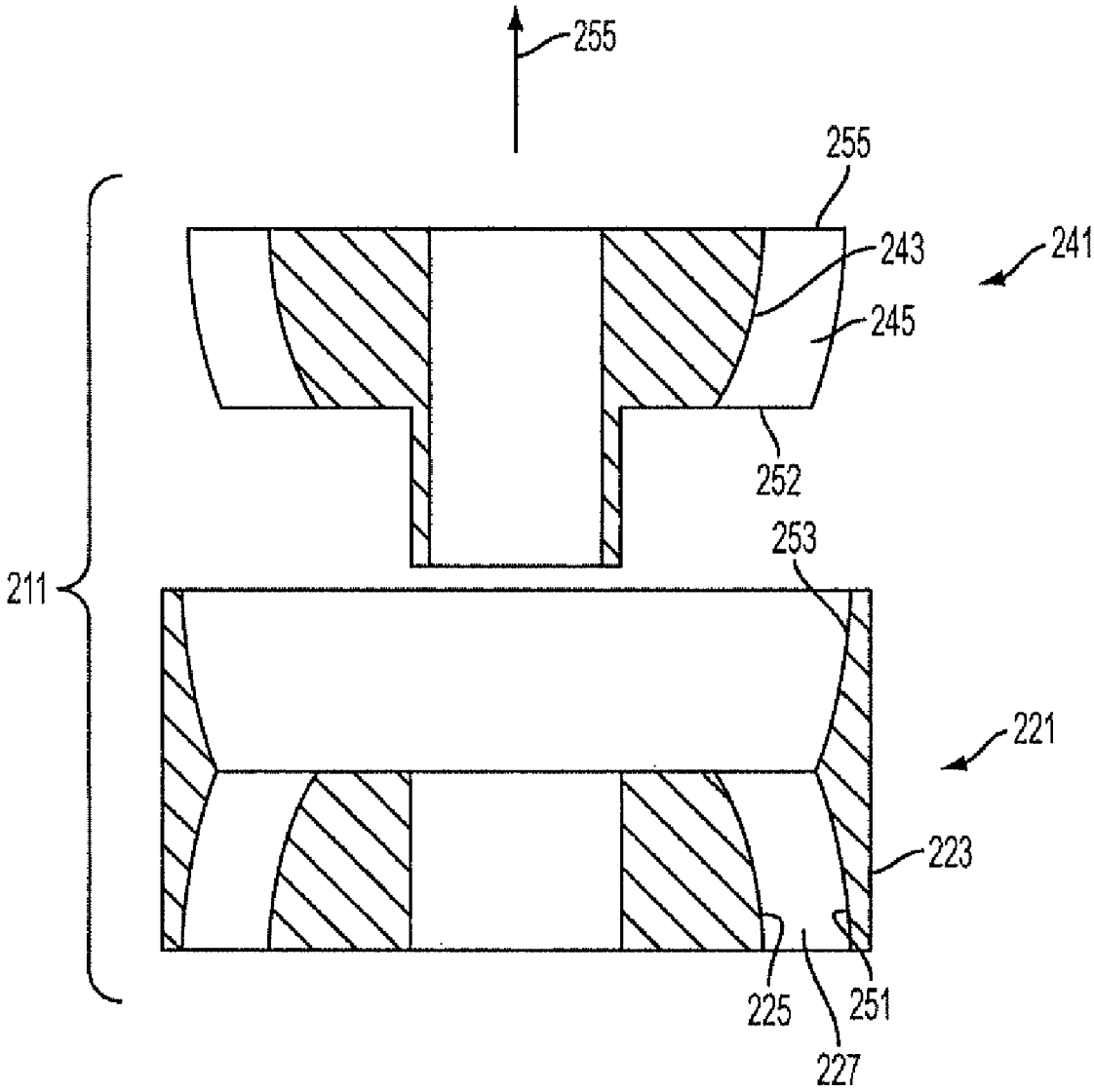
FIG. 12 is an exploded sectional side view of still another embodiment of an impeller and diffuser assembly constructed in accordance with the invention.

The mixing stage provides fluid homogenization of two-phase flow when the mixing stage is inserted or interspersed with other pump stages (e.g., FIGS. 8 and 9). The mixing stage(s) also assist the pump by increasing the head pressure as it nears gas lock condition and increases the volume of fluid that the pump can ingest. However, the mixing device is not necessarily a modified turbine. A "straight vane mixer" is a device that uses straight vanes that are perpendicular to an axis of the pump. Straight vane mixers create turbulence and homogenize the fluids, but produce very little or no head pressure. When a straight vane mixer is positioned upstream from an impeller it will aid in homogenizing the fluid, but lacks the ability to assist the stages performance.

Figure 1:
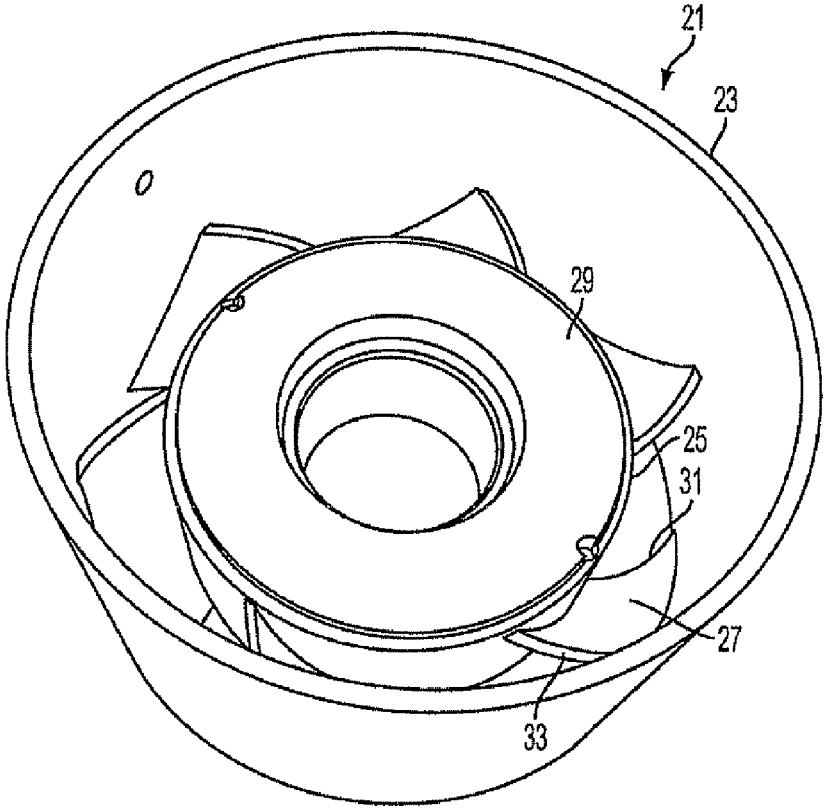
FIG. 1 is a top isometric view of one embodiment of a diffuser mounted inside a ring and is constructed in accordance with the invention.
Figure 2:
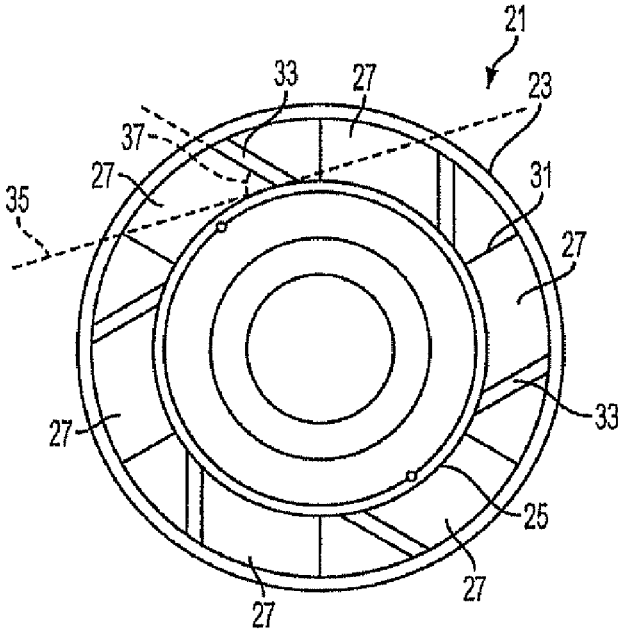
FIG. 2 is a top view of the diffuser of FIG. 1 and is constructed in accordance with the invention.
Figure 6:
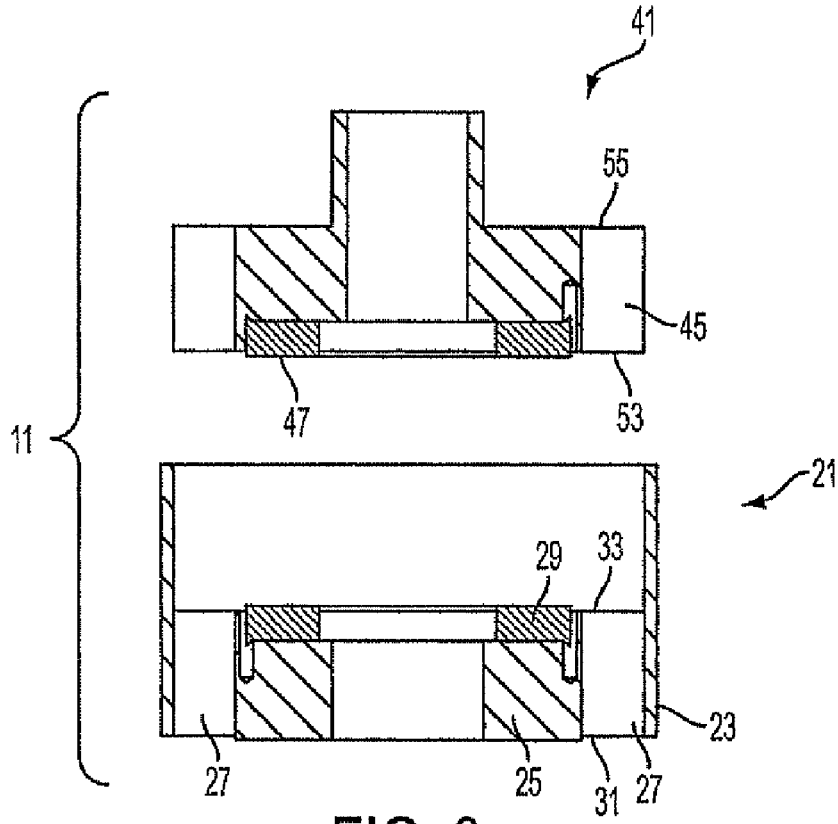
FIG. 6 is an exploded sectional side view of one embodiment of a diffuser and impeller assembly constructed in accordance with the invention.
Figure 7:
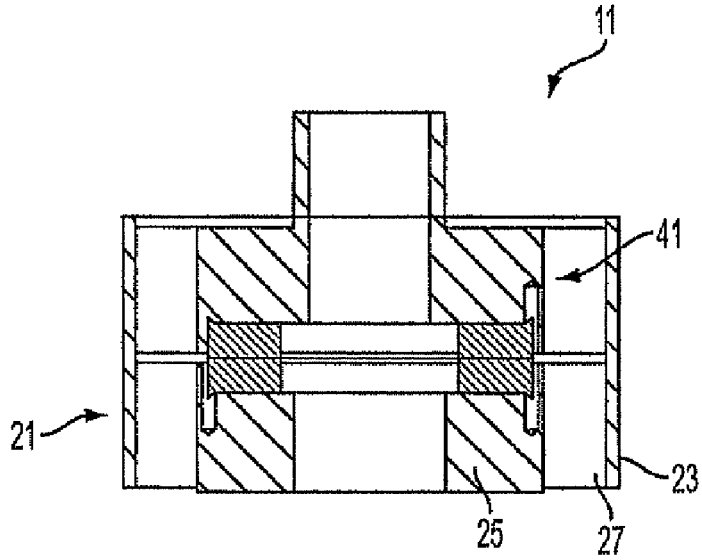
FIG. 7 is a sectional side view of the diffuser and impeller assembly of FIG. 6 and is constructed in accordance with the invention.

Referring now to FIGS. 1, 2 and 6, detailed views of one embodiment of a diffuser 21 utilized by the mixing stage 11 are shown. The diffuser 21 has a cylindrical housing 23, a diffuser body 25, and a plurality of fixed diffuser vanes 27 (e.g., six shown) extending radially or, in some embodiments, tangentially between the housing 23 and body 25. The body 25 and vanes 27 may be located in the lower half of housing 23 as illustrated. As shown in FIG. 1, the upper surface of the body 25 may be provided with a cylindrical thrust ring 29.

Each vane 27 has a leading edge 31 and a trailing edge 33. In one embodiment, the vanes 27 extend from the body 25 at acute angles relative to tangential directions at the respective intersections with body 25 (see, e.g., tangent 35 and angle 37 in FIG. 2). For example, the acute angle 37 may be in the range of 0 to 90 degrees and, in some embodiments, 10 to 40 degrees. The closer the vanes are to tangent (i.e., 0 degrees), the greater the force towards the center of the body.

In addition, each vane 27 may be curved in one or more dimensions, rather than being configured as merely flat blades. In the embodiment of FIG. 1, the vanes 27 are curved in both the axial direction (i.e., from top to bottom) and in the radial direction (i.e., between their inner and outer diameters). Regardless of the geometry or configuration utilized, vanes 27 are designed to force fluids impinging thereon to have a radially inward component (i.e., toward body 25) to create turbulence. This turbulence mixes and homogenizes the gas and liquid fluids to improve the overall performance of centrifugal pump assemblies that operate in two-phase fluids.

Figure 3:
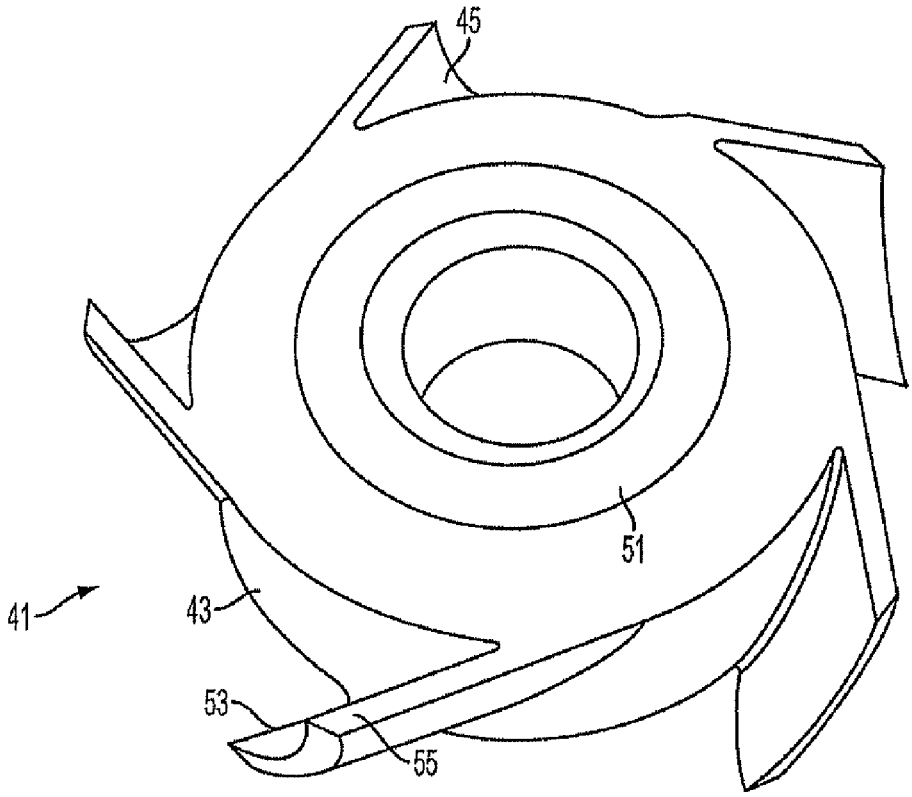
FIG. 3 is a top isometric view of one embodiment of an impeller constructed in accordance with the invention.
Figure 4:
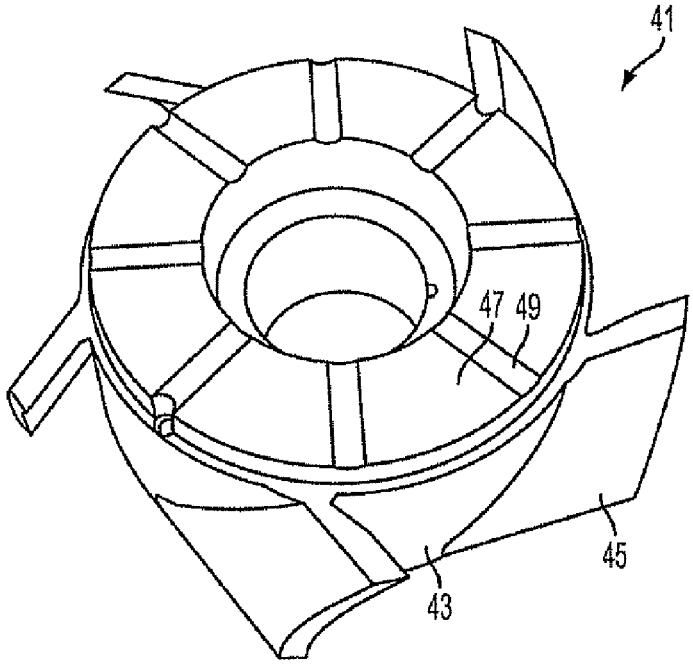
FIG. 4 is a bottom isometric view of the impeller of FIG. 3 and is constructed in accordance with the invention.
Figure 5:
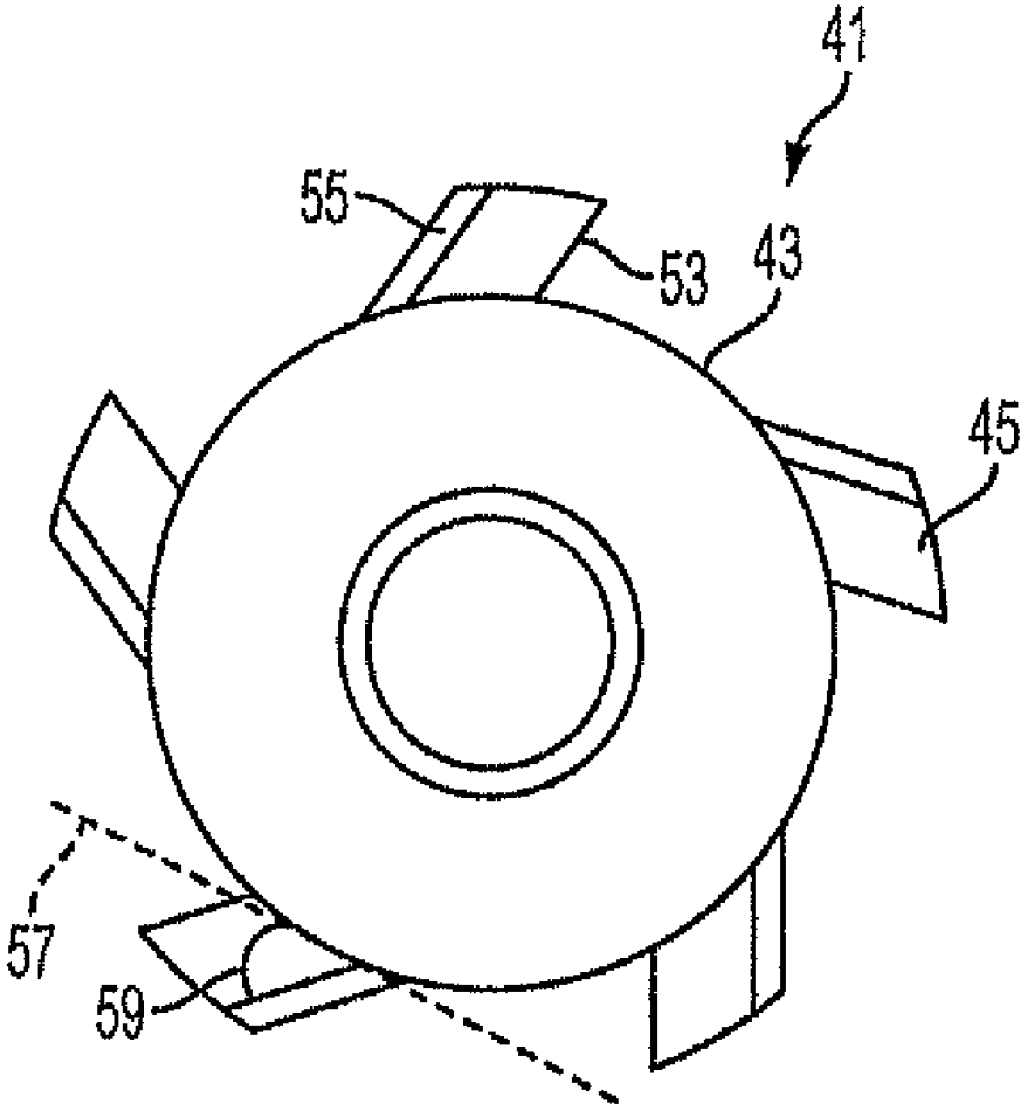
FIG. 5 is a top view of the impeller of FIG. 3 and is constructed in accordance with the invention.

Referring now to FIGS. 3-5, detailed views of one embodiment of an impeller 41 utilized by the mixing stage 11 are shown. In the illustrated embodiment of FIG. 7, the impeller 41 sits on top of the diffuser 21. The impeller 41 has an impeller body 43 (e.g., which may be cylindrical) and a plurality of impeller vanes 45 (e.g., five shown) extending radially and, in some embodiments, tangentially from body 43.

The vanes 45 may be configured with the same axial dimension as body 43 as shown. As shown in FIG. 4, the lower surface of body 43 may be provided with a cylindrical thrust runner 47 (e.g., formed from silicon carbide) having a plurality of radial grooves 49 on one surface and a smooth flat surface on an opposite side. This configuration may be reversed for some embodiments. In addition, an up thrust protection ring 51 (see, e.g., FIG. 3) may be formed from cotton fiber, such as cotton weave electric phenolic (CWEP), or other suitable material. The up thrust protection ring 51 may be positioned on an upper surface of body 43.

Each vane 45 has a leading edge 53 and a trailing edge 55. In one embodiment, the vanes 45 extend from the body 43 at acute angles relative to tangential directions at the respective intersections with body 43 (see, e.g., tangent 57 and angle 59 in FIG. 5). For example, the acute angle 59 may be in the range of 0 to 90 degrees and, in some embodiments 10 to 40 degrees. Again, the closer the vanes are to tangent (i.e., 0 degrees), the greater the force towards the center of the body.

In addition, each vane 45 may be curved in one or more dimensions, rather than being configured as merely flat blades. In the embodiment illustrated, the vanes 45 are curved only in the axial direction (i.e., from top to bottom) but not in the radial direction (i.e., between their inner and outer diameters). Thus, in the top view of FIG. 5, vanes 45 extend straight out from body 43 at angles 59, rather than in the curved configuration of vanes 27 in FIG. 1. Regardless of the geometry or configuration utilized, vanes 45 are designed to impart a radially inward component (i.e., toward body 43) on fluids to create turbulence. This turbulence mixes and homogenizes the gas and liquid fluids to improve the overall performance of centrifugal pump assemblies that operate in two-phase fluids.

The impeller is the first part of the pump stage that contacts the fluid. The velocity and rotation produced by the impeller is expanded and redirected by the diffuser. In a multi-stage pump, the impeller is followed by a diffuser. The particular configuration described herein has the diffuser preceding the impeller for two reasons. First, the standard diffuser delivers the fluid close to the center of the pump. The mixing impeller mainly provides axial flow and requires the fluid to enter closer to the periphery. Therefore, when transitioning from standard pump stages, a mixing stage diffuser initially receives flow from a standard pump impeller and delivers it to the mixing stage impeller. The last mixing stage impeller delivers the flow to a standard stage diffuser. The standard diffuser lacks a good location for a thrust bearing and axial impellers create a large quantity of thrust. If the pump comprised only the mixing stages, the stack of stages would start with a mixing stage diffuser to prevent pre-rotation of the fluid and provide a thrust bearing location.

In other embodiments, a mixing stage 211 (FIG. 12) having a diffuser 221 and impeller 241 may incorporate non-cylindrical shapes. Some configurations of impeller 241 (see, e.g., FIG. 11) may utilize a hub 243 with tapered or curved surfaces (e.g., spherically curved) where blades 245, having leading edges 253 and trailing edges 255, attach thereto. Likewise, diffuser 221 may be provided with a curved hub 225, a housing 223 and a plurality of fixed diffuser vanes 227 extending between the housing 223 and hub 225.

In still other embodiments, curved surfaces may be used for both the hubs 225, 243 and the inner walls 251, 252 (FIG. 12) adjacent blades 227, 245, respectively. Thus, the straight hub cylinder is a simplified configuration. Generally, the hub of the impeller and its outer fluid boundary or wall expand outward in the direction of the flow, and the hub of the diffuser (and its outer fluid boundary) moves inward along the direction of the flow indicated by arrow 255 in FIG. 12. Fluid initially flows through the diffuser 221 and then through the impeller 241, although conventional pumps start with an impeller and end with a diffuser. For the reasons stated above, this embodiment of the pump has an entrance diffuser before the impeller, and the stack starts and ends with a diffuser.

While the invention has been shown or described in only some of its forms, it should be apparent to those skilled in the art that it is not so limited, but is susceptible to various changes without departing from the scope of the invention.

We claim:

1. A centrifugal pump assembly, comprising:

a housing having an axis and a plurality of pump stages with pump impellers; and a mixing stage located within the housing for homogenizing two-phase fluids including gas and liquid to reduce accumulation of gas in the pump impellers, the mixing stage comprising:

a diffuser having a diffuser housing, a diffuser body, and a plurality of diffuser vanes extending radially or tangentially between the housing and the body; and an impeller having an impeller body and a plurality of impeller vanes extending radially or tangentially from the impeller body.

2. A centrifugal pump assembly according to claim 1, wherein the body and the diffuser vanes are located in an axial half of the housing.

3. A centrifugal pump assembly according to claim 1, wherein each diffuser vane has a leading edge, a trailing edge, and extends from the body at an acute angle relative to a tangential direction at a respective intersection with the body.

4. A centrifugal pump assembly according to claim 3, wherein the acute angle is in a range of 10 to 40 degrees.

5. A centrifugal pump assembly according to claim 1, wherein each diffuser vane is curved in at least one dimension selected from an axial direction and a radial direction.

6. A centrifugal pump assembly according to claim 1, wherein fluids enter the diffuser before the impeller.

7. A centrifugal pump assembly according to claim 1, wherein the diffuser housing and the impeller body are cylindrical.

8. A centrifugal pump assembly according to claim 1, wherein the impeller vanes have a same axial dimension as the impeller body.

9. A centrifugal pump assembly according to claim 1, wherein an upper surface of the body has a cylindrical thrust ring, and the impeller body has a lower surface with a cylindrical thrust runner.

10. A centrifugal pump assembly according to claim 9, wherein the cylindrical thrust ring and the cylindrical thrust runner are formed from silicon carbide, and the cylindrical thrust runner has a plurality of radial grooves on one surface and a smooth flat surface on an opposite side; and further comprising: an up-thrust protection ring formed from cotton fiber positioned on an upper surface of the impeller body.

11. A centrifugal pump assembly according to claim 1, wherein each impeller vane has a leading edge, a trailing edge, and extends from the impeller body at an acute angle relative to a tangential direction at a respective intersection with the impeller body.

12. A centrifugal pump assembly according to claim 11, wherein the acute angle is in a range of 10 to 40 degrees.

13. A centrifugal pump assembly according to claim 1, wherein each impeller vane is curved in at least one dimension selected from an axial direction and a radial direction.

14. A centrifugal pump assembly according to claim 1, wherein the diffuser and the impeller incorporate non-cylindrical shapes, the impeller having a hub with a spherically curved surface, and the diffuser having a spherically curved hub and the diffuser housing having inner walls with spherically curved surfaces.

15. A centrifugal pump assembly according to claim 1, wherein the mixing stage is an axial flow turbine that produces high shut-in head pressure, a high maximum flow rate, and improves performance of the pump stages.

16. A centrifugal pump assembly according to claim 1, wherein the mixing stage is located at a bottom of the centrifugal pump assembly.

17. A centrifugal pump assembly according to claim 1, wherein the mixing stage comprises a plurality of mixing stages that are axially spaced apart from each other within the housing.

18. A centrifugal pump assembly, comprising:

a housing having an axis and a plurality of pump stages with pump impellers; and a mixing stage located within the housing for homogenizing two-phase fluids including gas and liquid to reduce accumulation of gas in the pump impellers, the mixing stage comprising:

a diffuser having a diffuser housing, a diffuser body, and a plurality of diffuser vanes extending radially or tangentially between the housing and the body;

an impeller having an impeller body and a plurality of impeller vanes extending radially or tangentially from the impeller body; and each diffuser vane has a leading edge, a trailing edge, and extends from the body at an acute angle relative to a tangential direction at a respective intersection with the body, and wherein the acute angle is in a range of 10 to 40 degrees.

19. A centrifugal pump assembly according to claim 18, wherein the body and the diffuser vanes are located in an axial half of the housing, and wherein each diffuser vane is curved in at least one dimension selected from an axial direction and a radial direction.

20. A centrifugal pump assembly according to claim 18, wherein fluids enter the diffuser before the impeller.

21. A centrifugal pump assembly according to claim 18, wherein the impeller vanes have a same axial dimension as the impeller body, and wherein the diffuser housing and the impeller body are cylindrical.

22. A centrifugal pump assembly according to claim 18, wherein an upper surface of the body has a cylindrical thrust ring, and the impeller body has a lower surface with a cylindrical thrust runner, and wherein the cylindrical thrust ring and the cylindrical thrust runner are formed from silicon carbide, and the cylindrical thrust runner has a plurality of radial grooves on one surface and a smooth flat surface on an opposite side; and further comprising: an up-thrust protection ring formed from cotton fiber positioned on an upper surface of the impeller body.

23. A centrifugal pump assembly according to claim 18, wherein each impeller vane has a leading edge, a trailing edge, and extends from the impeller body at an acute angle relative to a tangential direction at a respective intersection with the impeller body, the acute angle is in a range of 10 to 40 degrees, and each impeller vane is curved in at least one dimension selected from an axial direction and a radial direction.

24. A centrifugal pump assembly according to claim 18, wherein the diffuser and the impeller incorporate non-cylindrical shapes, the impeller having a hub with a spherically curved surface, and the diffuser having a spherically curved hub and the diffuser housing having inner walls with spherically curved surfaces.

25. A centrifugal pump assembly according to claim 18, wherein the mixing stage comprises a plurality of mixing stages that are axially spaced apart from each other within the housing, each mixing stage is an axial flow turbine that produces high shut-in head pressure, a high maximum flow rate, and improves performance of the pump stages, and one of the mixing stages is located at a bottom of the centrifugal pump assembly.

* * * * *